US008079601B2

(12) United States Patent
Scardigno

(10) Patent No.: US 8,079,601 B2
(45) Date of Patent: Dec. 20, 2011

(54) PREFABRICATED COMPLEX JOINT SEALER

(76) Inventor: Philip Anthony Scardigno, Fulham Gardens (AU)

( * ) Notice: Subject to any disclaimer, the term of this patent is extended or adjusted under 35 U.S.C. 154(b) by 622 days.

(21) Appl. No.: 11/474,810

(22) Filed: Jun. 26, 2006

(65) Prior Publication Data

US 2008/0005977 A1 Jan. 10, 2008

(30) Foreign Application Priority Data

Jul. 1, 2005 (AU) ..... 2005903482

(51) Int. Cl.
*F16J 15/02* (2006.01)
*E04B 1/684* (2006.01)

(52) U.S. Cl. ..... 277/651; 277/654; 52/273; 52/420; 52/396.05

(58) Field of Classification Search ..... 277/316, 277/651, 654; 52/273, 417, 420, 396.05; 428/58

See application file for complete search history.

(56) References Cited

U.S. PATENT DOCUMENTS

| | | | | | |
|---|---|---|---|---|---|
| 791,552 | A | * | 6/1905 | Hance | 442/10 |
| 1,370,234 | A | * | 3/1921 | Stewart | 442/15 |
| 2,292,024 | A | * | 8/1942 | Dreher | 428/317.3 |
| 2,314,523 | A | * | 3/1943 | Speer | 52/417 |
| 2,637,995 | A | * | 5/1953 | Mann | 52/125.2 |
| 2,746,891 | A | * | 5/1956 | Doane | 52/284 |
| 2,974,078 | A | * | 3/1961 | Petritz et al. | 52/417 |
| 3,091,821 | A | * | 6/1963 | Cook, Jr. | 428/100 |
| 3,109,207 | A | * | 11/1963 | Cooper | 52/255 |
| 3,408,250 | A | * | 10/1968 | Finefrock | 428/121 |
| 3,475,260 | A | * | 10/1969 | Stokes | 428/57 |
| 3,616,113 | A | * | 10/1971 | Sawyer | 220/683 |
| 3,694,976 | A | * | 10/1972 | Warshaw | 52/58 |
| 3,708,379 | A | * | 1/1973 | Flint | 428/58 |
| 3,814,530 | A | * | 6/1974 | Neff | 404/67 |
| 3,895,145 | A | * | 7/1975 | McPherson | 428/53 |
| 4,055,925 | A | * | 11/1977 | Wasserman et al. | 52/396.04 |
| 4,071,994 | A | * | 2/1978 | Ammann | 52/393 |
| 4,189,877 | A | * | 2/1980 | Jentoft et al. | 52/58 |
| 4,295,311 | A | * | 10/1981 | Dahlberg | 52/396.05 |
| 4,378,394 | A | * | 3/1983 | Miura et al. | 428/113 |
| 4,437,283 | A | * | 3/1984 | Benoit | 52/410 |
| 4,563,379 | A | * | 1/1986 | Kruger | 428/61 |
| 4,688,361 | A | * | 8/1987 | Kelly | 52/173.1 |
| 4,744,840 | A | * | 5/1988 | Addleman | 156/71 |
| 4,825,613 | A | * | 5/1989 | Verble | 52/408 |
| 4,849,268 | A | * | 7/1989 | Backenstow et al. | 428/57 |
| 4,866,898 | A | * | 9/1989 | LaRoche et al. | 52/396.01 |
| 4,932,171 | A | * | 6/1990 | Beattie | 52/58 |
| 4,989,385 | A | * | 2/1991 | McCullough | 52/514 |
| 5,628,159 | A | * | 5/1997 | Younts | 52/417 |
| 5,843,552 | A | * | 12/1998 | Karrfalt | 428/57 |
| 6,145,259 | A | * | 11/2000 | Koenig et al. | 52/287.1 |
| 6,293,069 | B1 | * | 9/2001 | Monda et al. | 52/460 |
| 6,453,628 | B2 | * | 9/2002 | Traxler | 52/169.14 |
| 6,506,466 | B1 | * | 1/2003 | Sieber et al. | 428/40.1 |
| 7,013,610 | B2 | * | 3/2006 | Kunz | 52/255 |
| 2004/0244315 | A1 | * | 12/2004 | Rust et al. | 52/198 |
| 2008/0086975 | A1 | * | 4/2008 | Nebesnak et al. | 52/741.4 |
| 2009/0001697 | A1 | * | 1/2009 | Carvalho Marques | 280/736 |

* cited by examiner

*Primary Examiner* — Alison Pickard
(74) *Attorney, Agent, or Firm* — Klauber & Jackson LLC

(57) ABSTRACT

A sealing member for sealing over a structural joint or compound expansion joint. The sealing member has an elastomeric portion to overlie the lines of the joint and an adhesive receiving region to the sides of the elastomeric portion. The adhesive receiving region is adapted to be adhered to material adjacent to the structural joint. The elastomeric portion extends along each line of the structural joint in use to allow relative movement along each joint to be absorbed by the elastomeric portion.

12 Claims, 11 Drawing Sheets

PREFABRICATED COMPLEX JOINT SEALER

CROSS REFERENCE TO RELATED APPLICATIONS

The present application claims priority from Australian Provisional Patent Application Serial No. 2005903482, filed on Jul. 1, 2005. Applicant claims priority under 35 U.S.C. §119 as to the said Australian application, and the entire disclosure of said application is incorporated herein by reference in its entirety.

FIELD OF INVENTION

This invention relates to a sealing member for structural joints, such as expansion joints, in building constructions.

BACKGROUND OF THE INVENTION

Where joints such as expansion joints are provided in building constructions and it is desired to seal across such expansion joints it is known to fill the joint with an elastomeric material or to place a strip of an elastomeric material over the line of the expansion joint and have fabric joined to either side of the elastomeric material so that the strip can be adhered to the surface of material either side of the expansion joint.

Where there is a compound joint such as a cross, T-piece or the like such an arrangement does not work successfully because the action of crossing two such strips creates region in the joint where no expansion can occur and the result is that any movement causes damage to the fabric of the expansion joint sealant.

The object of this invention is to provide sealing members for compound expansion joint in building constructions as well as sealing members for three dimensional compound joints.

The term compound expansion joint is herein intended to mean a set of expansion joints in a building construction which meet at a point or at which the joint extends in more than two dimensions. The expansion joints may be in two or three dimensions.

Other types of joints in building to which the present invention is applicable are where there is flashing between components such as in roofing. In the past lead flashing has been used but with health concerns with lead other forms of sealing in such situations are desirable. Often flashings are necessary in more than two dimension such as in internal or external corners and problems with the use of existing flashing systems can occur.

DESCRIPTION OF THE INVENTION

In one form therefore the invention is said to reside in a sealing member for a compound joint defined by joint lines in at least two dimensions in a building construction, the sealing member including an elastomeric portion adapted in use to overlie the lines of the joint and an adhesive receiving region to each side of the elastomeric portion, the adhesive receiving region adapted to be adhered to material adjacent to the expansion joint, the elastomeric portion extending along each line of the joint in use.

Preferably the elastomeric portion is in a shape selected from the group comprising planar shapes including T-shaped, L-shaped, cross-shaped and star-shaped and three dimensional shapes including intersection of curves and straight lines inside corners, outside corners and the like.

The adhesive receiving region preferably comprises a fabric selected from the group comprising natural or synthetic material including cotton fabric or wool fabric or fibreglass cloth, polyester fabric or polypropylene cloth and in woven, non-woven or fleecy form or felt-like material.

Alternatively the adhesive receiving region comprises a plurality of apertures through the sheet material whereby adhesive can pass through the apertures to assist in adhering to the material adjacent to the expansion joint. The apertures may have a diameter of from 1 to 5 mm.

At least the elastomeric region may be formed from a material selected from the group comprising nitrile butadiene rubber, ethylene propylene diamine rubber, butyl rubber, isoprene isobutyl rubber, urethane elastomers, neoprene, styrene butadiene rubber and the like.

The sealing member may have a thickness applicable to the type of application to which it is to be applied. The sealing member may have a thickness in the range of 0.25 to 10 mm and more particularly for most domestic and building applications have a thickness in the range of 0.5 to 5 mm. The elastomeric region may have a width of from 10 to 200 mm.

Generally it will be seen that the sealing member for compound expansion joints according to the present invention has a free zone of elastomeric material which in use overlies the joint such as an expansion joint to allow relative movement across or along the expansion joint and a zone around the periphery of the free zone which enables the sealing member to be adhered to the surface around the expansion joints. A further covering can then be placed over the sealing member such as a cover plate, tiles in the case of expansion joints in walls and floors or roofing coatings such as sealing membranes applied as liquids.

In one form the sealing member may be adapted for use sealing a skylight into a roof structure or pipes into or through walls floors and the like.

BRIEF DESCRIPTION OF THE DRAWINGS

This then generally describes the invention but to assist with understanding reference will now be made to the accompanying drawings which show preferred embodiments of the invention.

In the drawings.

DESCRIPTION OF PREFERRED EMBODIMENTS

Figure 1:
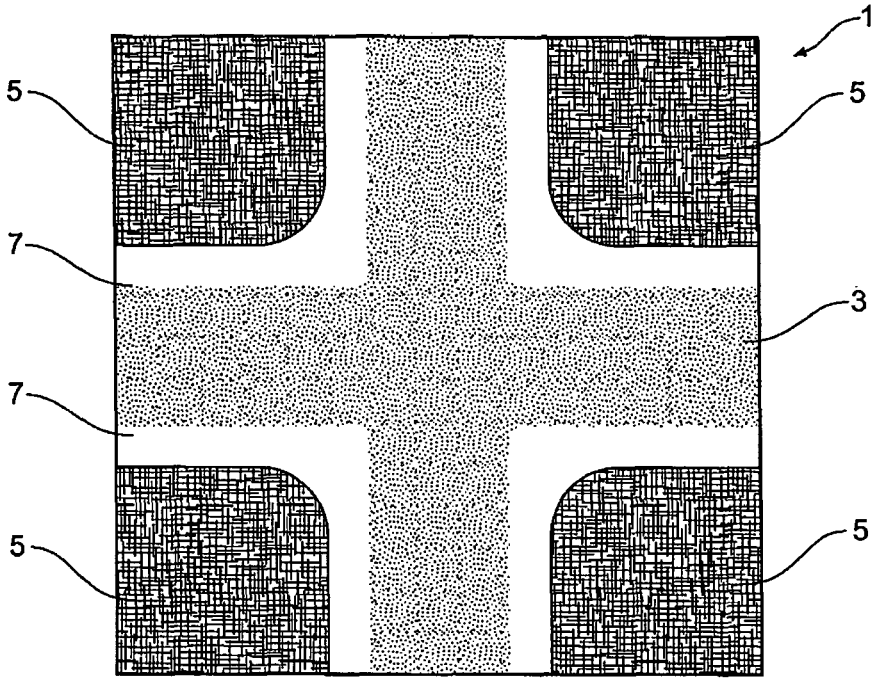
FIG. 1 shows a first embodiment of a sealing member for a compound expansion joint according to one embodiment of the invention.

Now looking more closely at the drawings and in particular FIG. 1 it will be seen that the sealing member 1 for a crossed compound expansion joint comprises an elastomeric region 3 in the shape of a cross (indicated by dot hatching) and surrounding the elastomeric region 3 are fabric portions 5 with a transition zone 7 between the elastomeric region 3 and the fabric portions 5. In the transition zones 7 the fabric is moulded into the elastomer so the transition zone is relatively inelastic. Alternatively the fabric of the fabric portion 5 is adhered to the elastomer in the transition zone 7.

Figure 12:
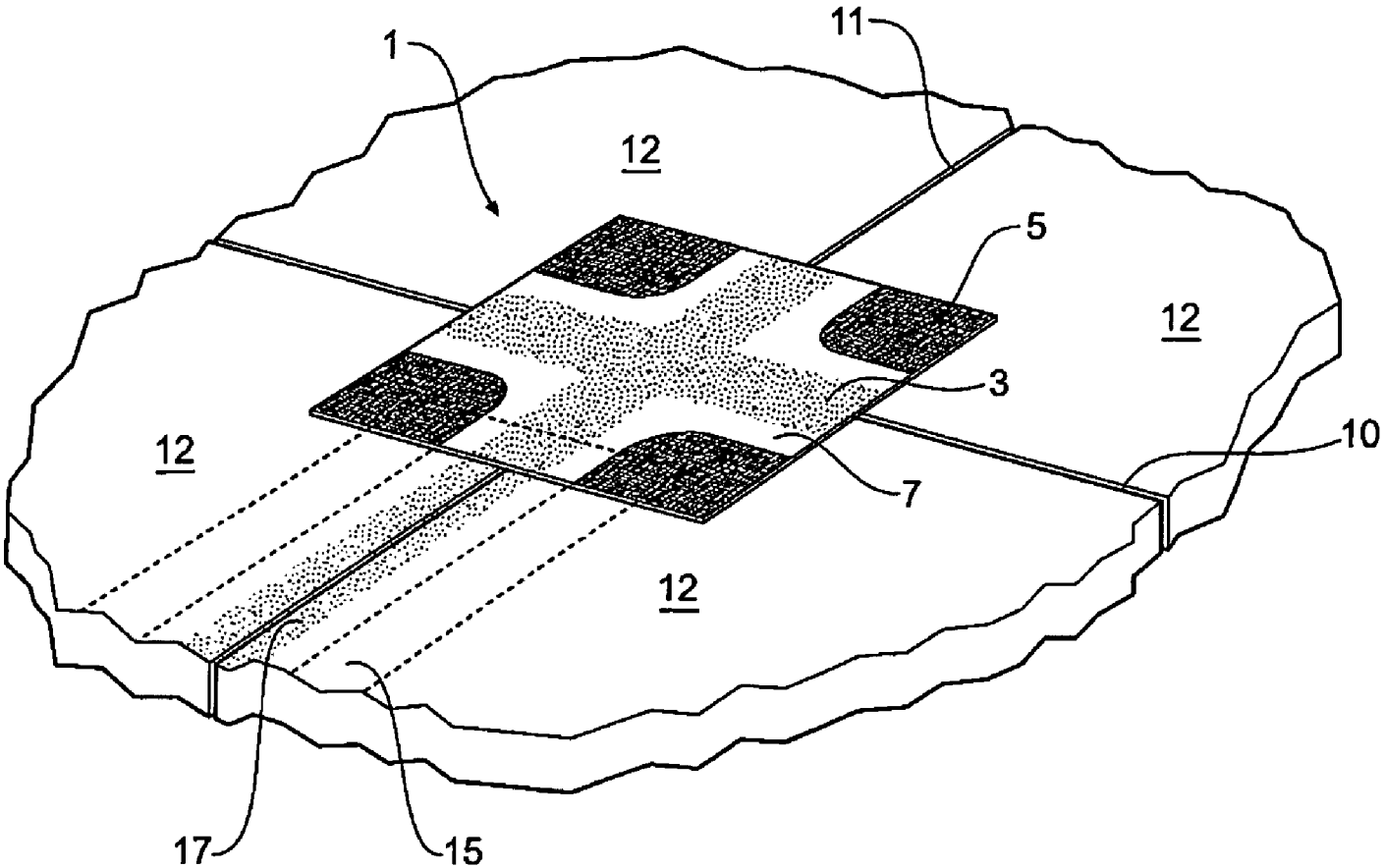
FIG. 12 shows the use of a sealing member of the type shown in FIG. 1 on a cross shaped compound expansion joint on a planar floor surface.

When it is desired to seal a crossed compound expansion joint using the device shown in FIG. 1 the arrangement as shown in FIG. 12 is used.

Referring now to FIG. 12 it will be seen that the sealing member 1 is placed onto the expansion joint so that cross shaped elastomeric region 3 of the sealing member shown in FIG. 1 is placed along the lines 10 and 11 being expansion joints in the concrete slabs 12 for instance. An adhesive can then be used on the fabric regions 5 and under the transition zones 7 to sealingly join the sealing member 1 to each portion of slab. A continuous strip of expansion joint sealing member 15 (shown dotted) can then be used joined onto the sealing member of the present invention and having its elastomeric portion 17 over the expansion joint 11. By this arrangement the slabs 12 can move individually and the elastomeric portion of the sealing member covers each line of the expansion to prevent leakage through the expansion joints while at the same time allowing movement at each joint. After placement of the sealing member of the present invention and the sealing strip 15 tiles or the like may be placed over the entire surface.

Figure 2:
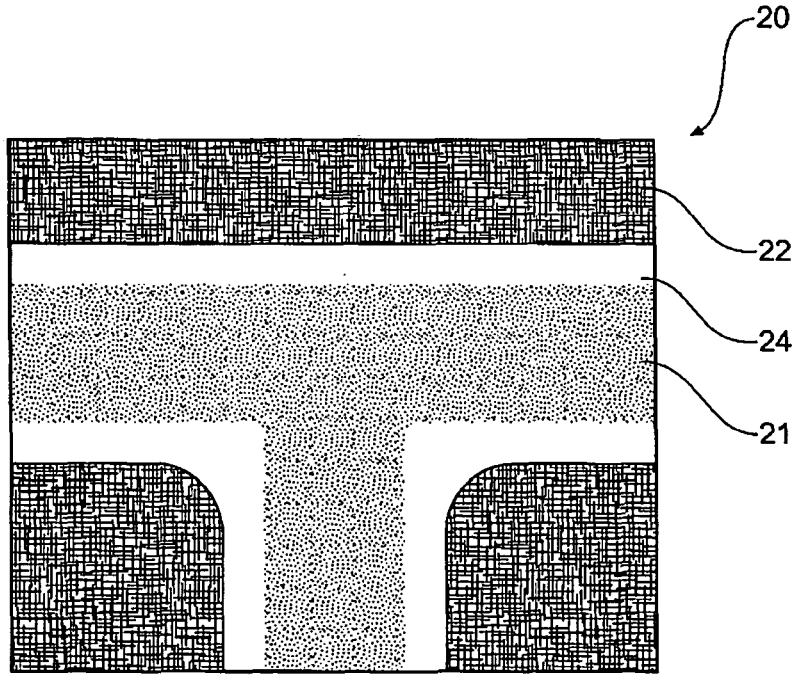
FIG. 2 shows a further embodiment of a sealing member for a compound expansion according to the present invention.

In FIG. 2 a sealing member 20 for a T-shaped junction of expansion joints is depicted. In this arrangement the elastomeric region 21 (indicated by dot hatching) is in the shape of a T and the fabric regions 22 are the side of the elastomeric region 21 with transition regions 24 where the fabric is sealed into or adhered onto the elastomeric portion.

Figure 3:
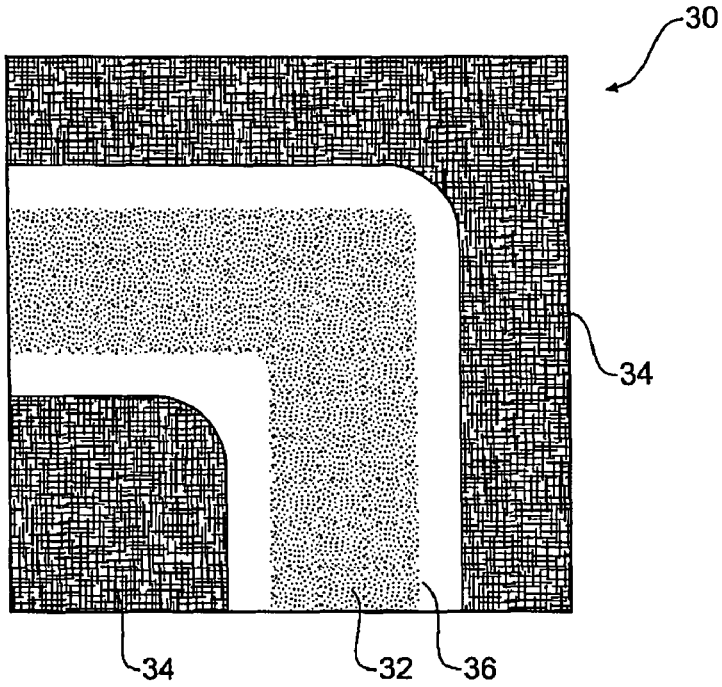
FIG. 3 shows a still further embodiment of a sealing member for a compound expansion joint according to the invention.

In FIG. 3 a sealing member for an L-shaped expansion joint is provided. The sealing member 30 has an elastomeric region 32 in the shape an L (indicated by dot hatching) and fabric regions 34 with transition regions 36 where the fabric is sealed into the elastomeric material.

The embodiments of sealing member shown on FIGS. 1 to 3 may have an elastomeric region with a width of from 10 mm-200 mm. The length and width of the sealing member can vary from 100 mm×100 mm up to 1 m×1 m. Their length and width dimensions may be rectangular as well as square shape.

Figure 4:
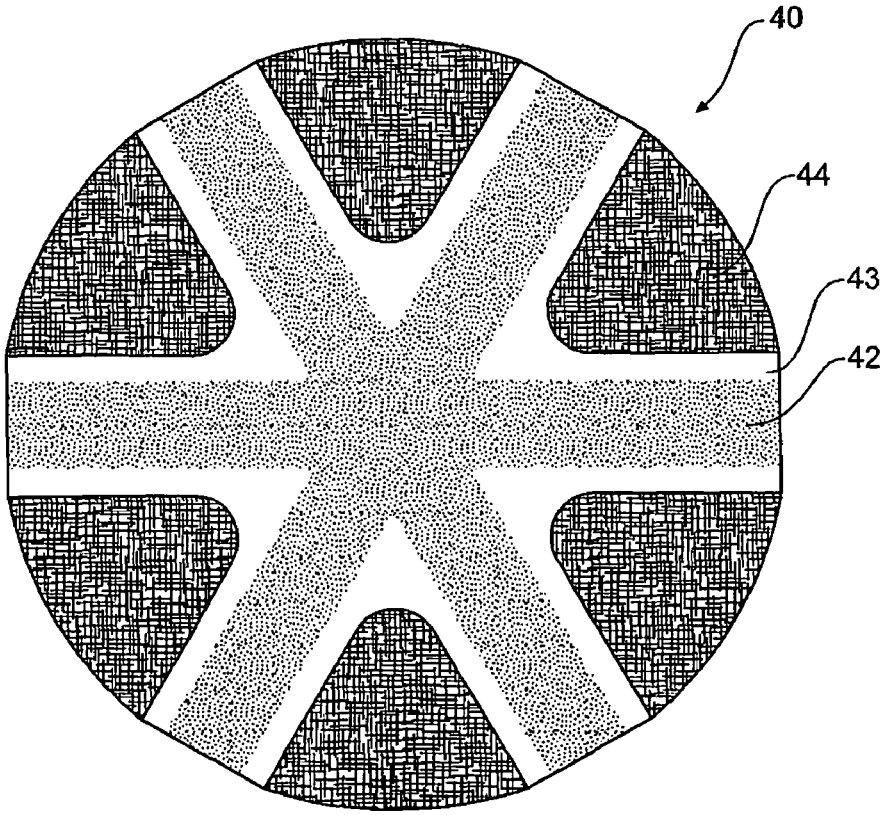
FIG. 4 shows a still further embodiment of a sealing member for a compound expansion joint for use on planar surfaces.

FIG. 4 shows a sealing member for an expansion joint where the expansion joint is in the shape of a star. Again the sealing member 40 has a star or asterisk shaped elastomeric portion 42 (indicated by dot hatching) and fabric portions 44 in between the arms of the elastomeric portions and transition regions 43 in between the elastomeric portion 42 and the cloth portions 44.

The embodiment of sealing member shown on FIG. 4 may have an elastomeric region with a width of from 10 mm-200 mm and the oveal;l sealing member can have a diameter of from 100 mm to 1 metre.

Figure 5:
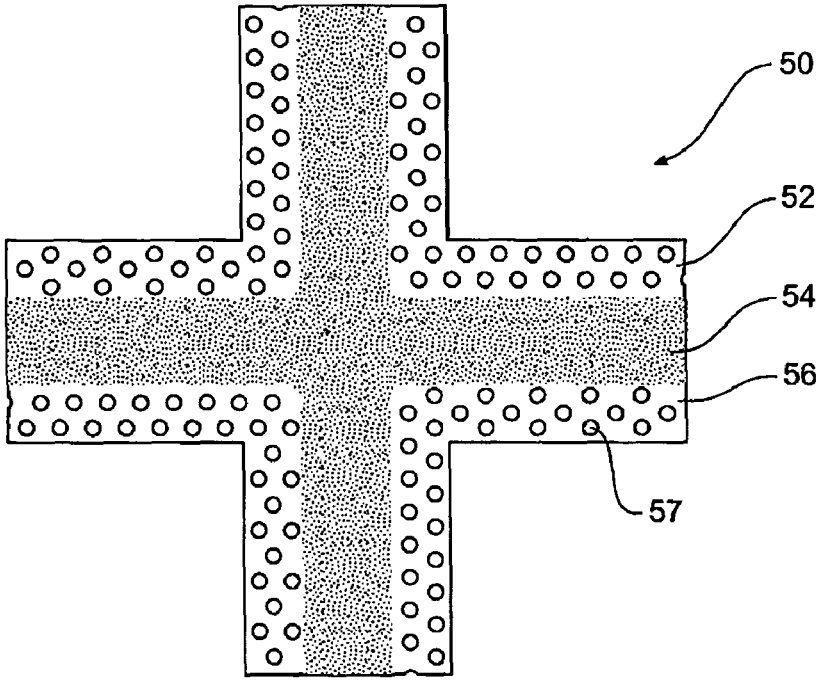
FIG. 5 shows an alternative embodiment of a sealing member for a crossed compound expansion joint according to the present invention.

FIG. 5 shows an alternative arrangement of a sealing member for a compound expansion joint. In this embodiment the sealing member 50 is comprised entirely of an elastomeric material 52. There is an imperforate central cross portion 54 (shown shaded) and perforated regions 56 with apertures 57 to the sides of the central cross portion 54. When this sealing member is to be mounted to the floor adhesive passes through the apertures 57 in the perforated regions 56 to seal the edges of the strip to the concrete adjacent to the expansion joint while still allowing independent movement of the four slabs of concrete around the joint via the elastomeric central cross portion.

Figure 6:
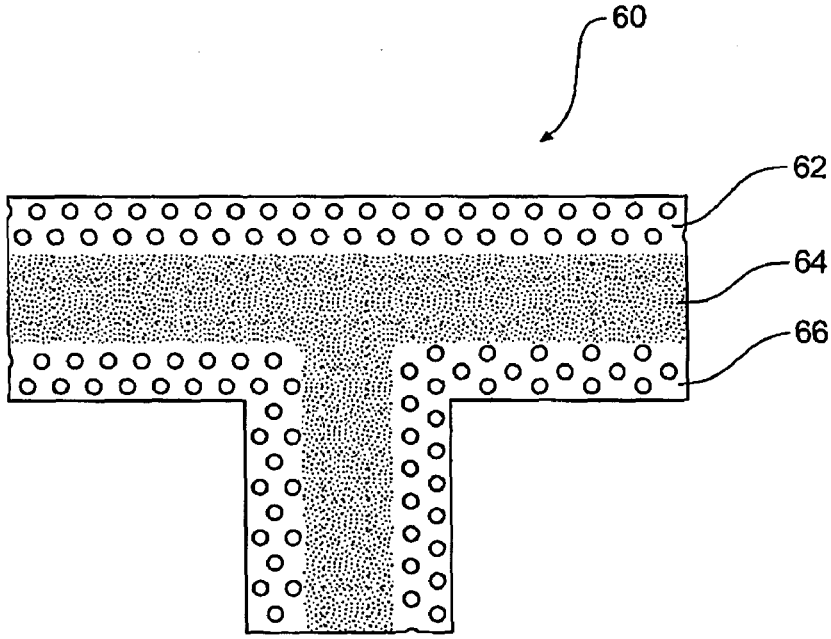
FIG. 6 shows a further embodiment of a compound expansion joint according to the present invention for use with a T-shaped compound expansion joint.

FIG. 6 shows an alternative embodiment of a sealing member for compound expansion joint in the shape of a letter T. The sealing member 60 is manufactured from a sheet 62 of elastomeric material with a central unperforated portion 64 (shown shaded) and perforated edges 66. The use of this embodiment of a sealing member is similar to that discussed in relation to FIG. 5.

Figure 7:
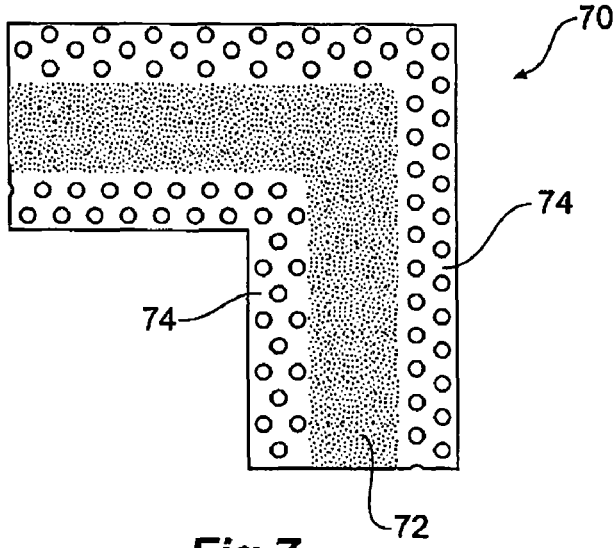
FIG. 7 shows a still further embodiment of a sealing member for a compound expansion joint.

FIG. 7 shows a similar embodiment to FIG. 6 but for use with an L-shaped expansion joint. In this arrangement the elastomeric material 72 (shown shaded) has two L-shaped lines of perforations 74 along its edges. The use of this embodiment of a sealing member is similar to that discussed in relation to FIG. 5.

The embodiments of sealing member shown on FIGS. 5, 6 and 7 have an imperforate central cross portion with a width of from 10 mm to 200 mm and a total width of the imperforate & perforated regions combined can be supplied from 50 mm to 600 mm and length of these regions can be made from 50 mm to 500 mm.

Figure 8:
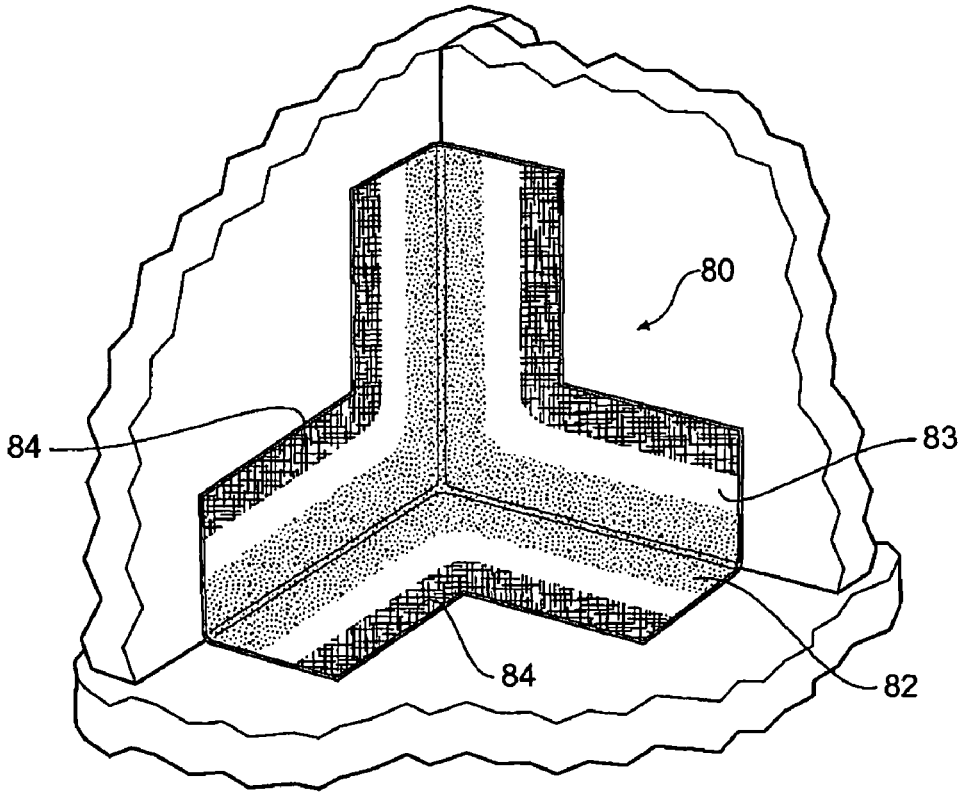
FIG. 8 shows an inside corner sealing member for a compound expansion joint according to the present invention.

FIG. 8 shows a compound or three dimensional sealing member suitable for sealing a three dimensional inside corner joint such as in a corner of a bathroom, a planter box or the like. In this arrangement the sealing member 80 comprises an elastomeric portion 82, transition zones 83 and fabric edges 84 in three different planes so that the sealing member fits into a corner. Adhesive can be placed on and through the fabric of the fabric edges 84 and under the edges of the transition zones 83 to fasten the sealing member to the underlying structure while allowing for movement along the corners of the structure.

Figure 9:
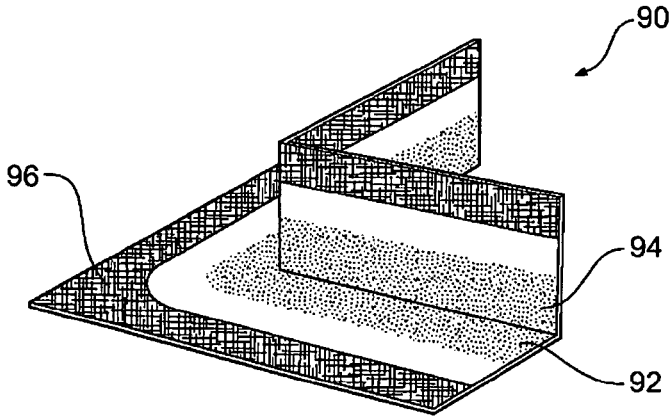
FIG. 9 shows a sealing member for a three dimensional outside corner.

FIG. 9 shows a sealing member 90 for an outside corner where sealing is desired. The compound expansion joint sealing member 90 has a planar portion of elastomeric material 92 and a folded portion 94 also of elastomeric material standing up from the elastomeric portion 92 so that an outside joint can be sealed. Cloth members 96 extend out from the elastomeric regions 92, 94 to enable the sealing member to be adhered to the underlying surfaces.

In FIGS. 8 and 9 the elastomeric portions can be supplied in widths of from 10 mm to 200 mm. Combined areas inclusive of elastomeric portion, transition zone and fabric edge can be supplied in widths of 100 mm to 600 mm. Lengths of each plane can be supplied from 100 mm to 500 mm.

Figure 10A:
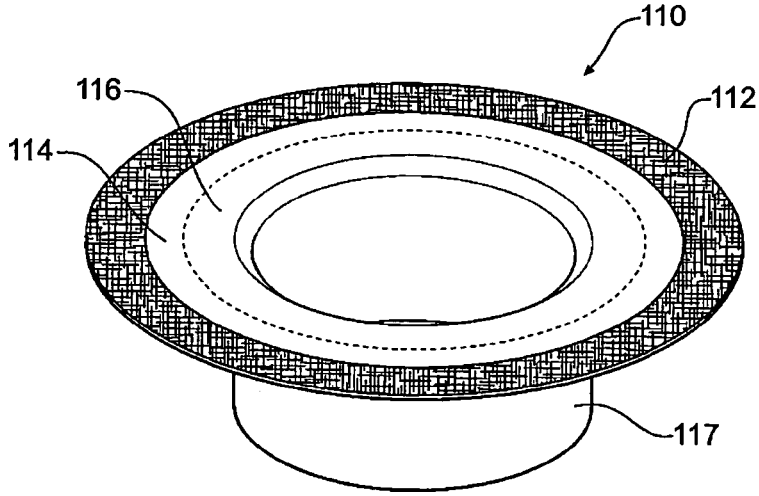
FIG. 10A shows an alternative embodiment of a sealing member according to the present invention.
Figure 10B:
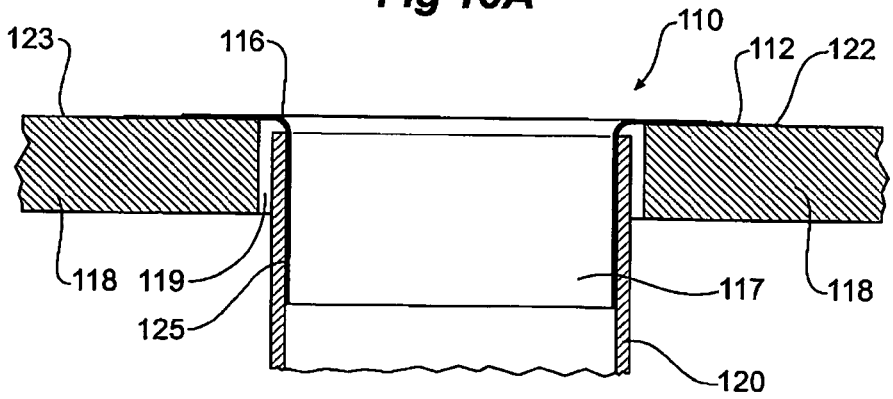
FIG. 10B shows the use of the embodiment of a sealing member of FIG. 10A to seal a pipe where it enters a floor slab.

FIG. 10A shows an alternative embodiment of a sealing member according to the present invention and FIG. 10B shows the use of the embodiment of the sealing member of FIG. 10A.

In FIG. 10A the sealing member 110 consists of an elastomeric planar portion 114 with a fabric extension 112 from the planar portion peripherally out from the portion 114 and then an elastomeric region 116 within the planar portion 114 curving into a tubular portion 117 extending away from the plane of the planar portion 114.

This sealing member is intended to seal where there is a joint between a concrete floor for instance and a pipe which extends through the floor and terminates at floor level, in for instance, a bathroom setting for a floor drain or shower drain. Differential expansion between the pipe and the floor means that the joint could move and cause leakage.

The sealing member shown in FIG. 10A can also be used to seal around a pipe passing through a wall or floor. In such a situation the tubular portion could be placed on the outside of the pipe as a sleeve and adhered thereto.

In FIG. 10A the diameter of aperture can be supplied from 20 mm to 400 mm. The full diameter of unit (inclusive of elastomeric planar potion and fabric) can be from 100 mm to 600 mm. The section extending downwards can be from 5 mm to 100 mm.

FIG. 10B shows a concrete slab 118 with an aperture 119 through it and into the aperture 119 extends a pipe 120. There is expected to be movement between the pipe 120 and the slab 118 and hence it is not possible to adhere the two together solidly.

The sealing member shown in FIG. 10A is therefore used to seal the pipe into the slab. The sealing member is placed so the planar portion 114 extends around the periphery of the aperture 119 on the surface 123 of the slab 118 with the tubular portion 117 extending down into the pipe and adhered at 125 to the inside surface of the pipe. The fabric portion 112 is adhered to the surface 123 as shown at 122. By this arrangement the elastomeric portion 116 enables movement between the pipe and the slab to be absorbed while at the same time sealing against any moisture passing through the aperture 119.

Figure 11:
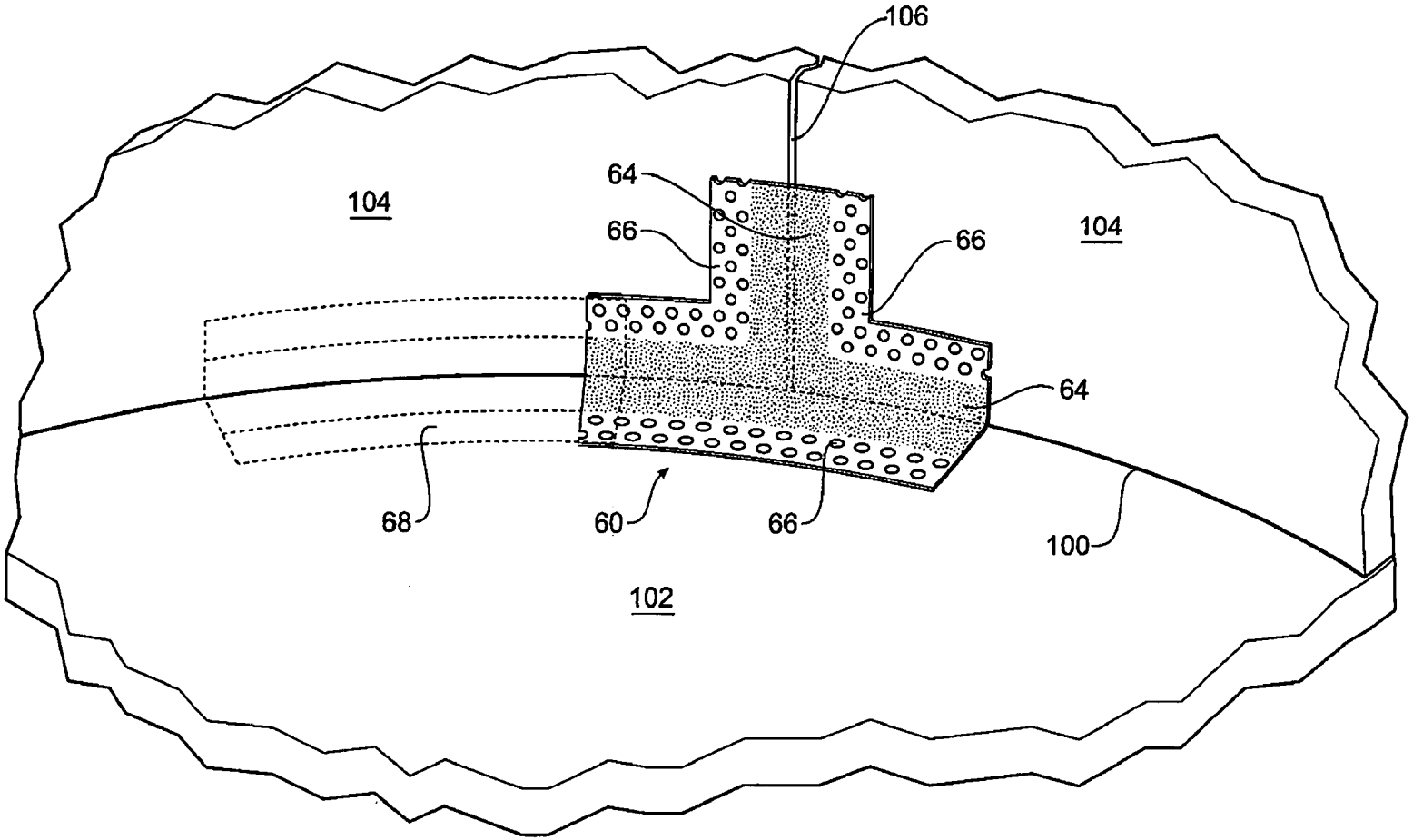
FIG. 11 shows a T-shaped sealing member for a compound expansion joint of the type shown in FIG. 6 for use with a curved surface meeting a floor.

FIG. 11 shows a T-shaped compound expansion joint sealing member of the type shown in FIG. 6 used to seal between the surface and sides of, for instance, a large concrete water tank or swimming pool. The tank has an expansion joint 100 between its floor slab 102 and upright sides 104 and a vertical expansion joint 106 between portions of the side 104. The sealing member 60 is placed so that the elastomeric region 64 overlies both the expansion joints 100 and 106 and the adhesive region 66 are to each side of the expansions joints. A continuous further strip of expansion joint sealing member 68 can be extended around the balance of the simple expansion joint 100.

Figure 13:
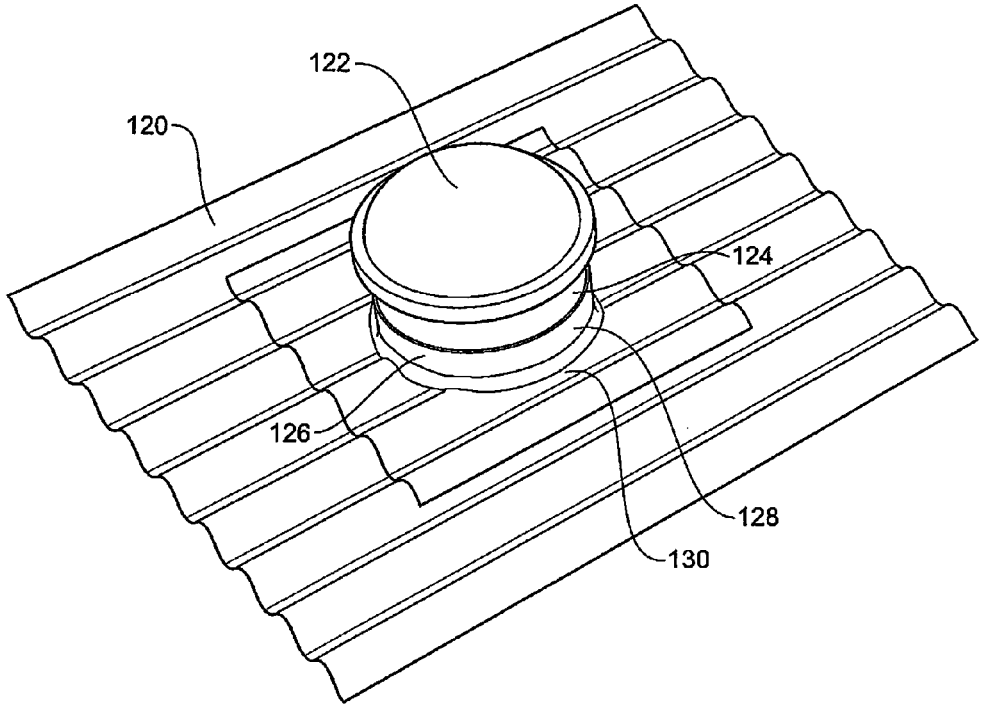
FIG. 13 shows a skylight extending through a roof and the sealing member according to one embodiment of the present invention used to seal and provide a flashing between the roof and the tube of the skylight.
Figure 14:
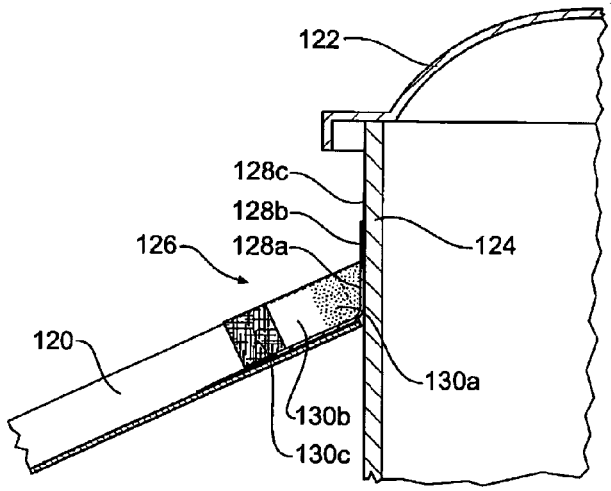
FIG. 14 shows a cross sectional detail of the embodiment shown in FIG. 13.

FIG. 13 shows a skylight extending through a roof and the sealing member according to one embodiment of the present invention used to seal and provide a flashing between the roof and the tube of the skylight and FIG. 14 shows a cross sectional detail of the embodiment shown in FIG. 13.

The roof 120 is illustrated as a corrugated galvanised iron roof but this invention is applicable to all forms of roofing. These may include other forms of corrugated metal such as Grecian profile, cliplock and the like as well as tiles of all kinds.

The roof 120 has a skylight 122 extending through it. The skylight has a tubular body 124. The sealing member 126 has a cylindrical wall portion 128 which fits around the tubular body and a flange portion 130 which extends out onto the surface of the roof 120. The cylindrical wall portion 128 comprises an elastomeric portion 128*a*, a transition zone 128*b* and an adhesion region 128*c*. Similarly the flange portion has a an elastomeric portion 130*a*, a transition zone 130*b* and an adhesion region 130*c*. The sealing member is fastened to the tubular body 124 and the roof 120 by adhesive in the adhesion regions 128*c* and 130*c* respectively. Some adhesive may extend to the transition zones 128*b* and 130*b* but the elastomeric regions 128*a* and 130*a* are relatively left free of adhesive to enable relative movement between the tubular body 124 and the roof 120 such as due to thermal expansion and contraction.

In this embodiment the sealing member is adapted to fit around a tubular body of a skylight of a selected diameter but alternatively the sealing member can be manufactured for other shapes of tubular body such as square, rectangular, hexagonal or oval and of a range of sizes. Alternatively the sealing member can be a continuous length and the user can select a suitable length for a particular circumference of body around which it is to be placed.

The invention in this embodiment has been discussed with reference to installation of a skylight through a roof structure but the invention is equally applicable to other application where an item passes through a roof or similar structure and flashing is required between the roof structure and the periphery of the item. Items can include chimneys, vents, pipes, ducting, cables, conduits and the like.

Figure 15:
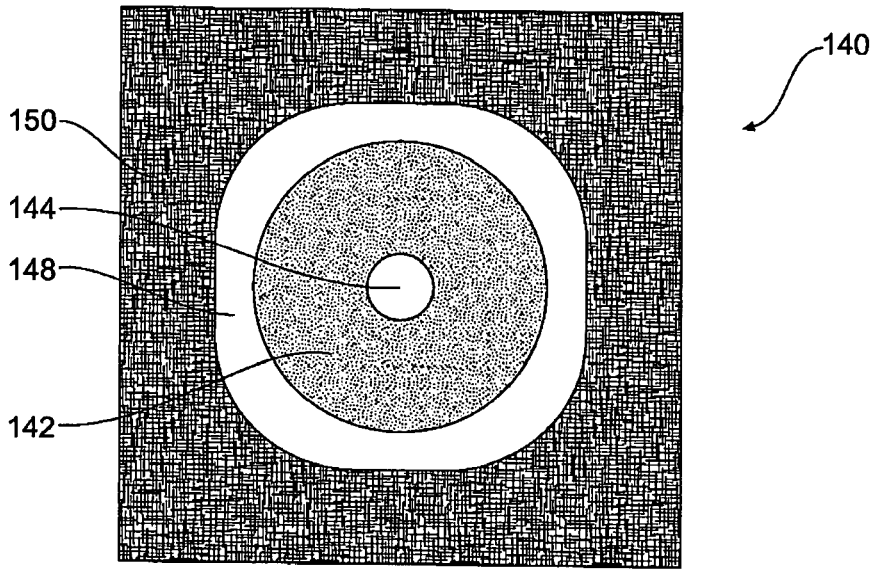
FIG. 15 shows a still further embodiment of sealing member according to the present invention.
Figure 16:
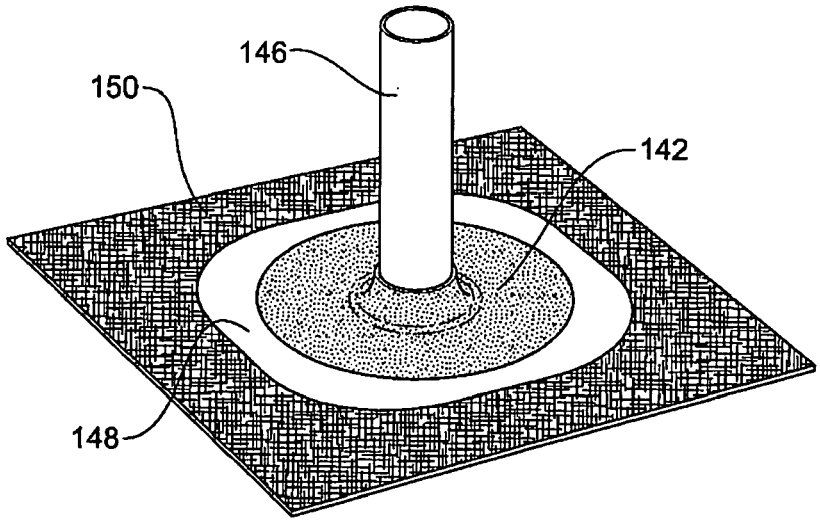
FIG. 16 shows use of the sealing member of FIG. 15.

FIG. 15 shows an alternative embodiment of sealing member according to the present invention for use sealing around a small pipe or the like passing through a surface such as a roof structure where there is expected to be relative movement between the pipe and the roof structure. FIG. 16 shows the use of the sealing member of FIG. 15.

The sealing member 140 comprises a central elastic portion 142 with a central aperture 144. The aperture is of lesser diameter than the diameter of the pipe it is intended to fit around so that it has a tight fit around the pipe 146 (FIG. 16) when installed. The central elastic portion 142 is surrounded by a transition portion 148 and an adhesion portion 150 surrounds the transition portion. When the sealing member 140 is placed on a pipe as shown in FIG. 16 the tight fit of the aperture 144 onto the pipe 146 provides sealing around the pipe and the elastomeric portion allows relative movement between the pipe and the roof structure to which the adhesion portion 150 is adhered.

In FIG. 15 the diameter of aperture can be from 1 mm to 400 mm. The central elastic portion can be supplied in diameter from 50 mm to 600 mm. The length and width of unit inclusive of fabric area can be from 80 mm to 1 m.

Figure 17:
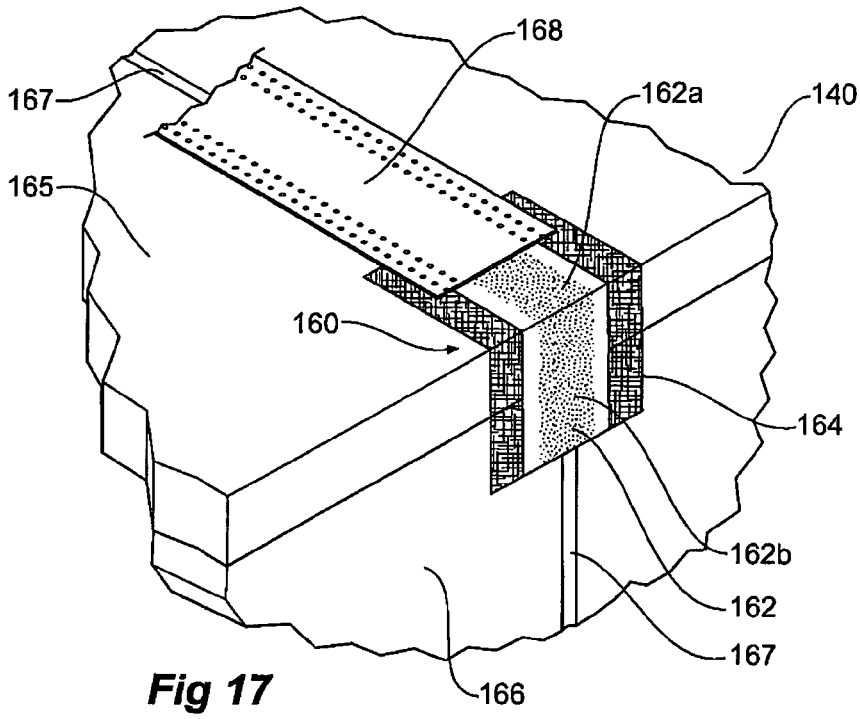
FIG. 17 shows an alternative embodiment of sealing member as an external capping member according to the present invention.

FIG. 17 shows an alternative embodiment of sealing member as an external capping member according to the present invention. The external capping sealing member 160 comprises an elastomeric region 162 in two planar portions 162*a* and 162*b* at right angles to each other and fabric adhesive receiving regions 164 to each side of the elastomeric region 162. The external capping sealing member 160 fits on the outside edge of a pair of concrete slabs 165, 166, for instance across an expansion joint 167. A continuous further strip of expansion joint sealing member 168 can be extended along the balance of the expansion joint 167 in each direction from the capping member.

In FIG. 17 the elastomeric portion can be from 10 mm to 200 mm. The total widths inclusive of elastomeric portion, transition zone and fabric can be from 100 mm to 1 m. Lengths adhered to surface can be from 100 mm to 600 mm.

Figure 18:
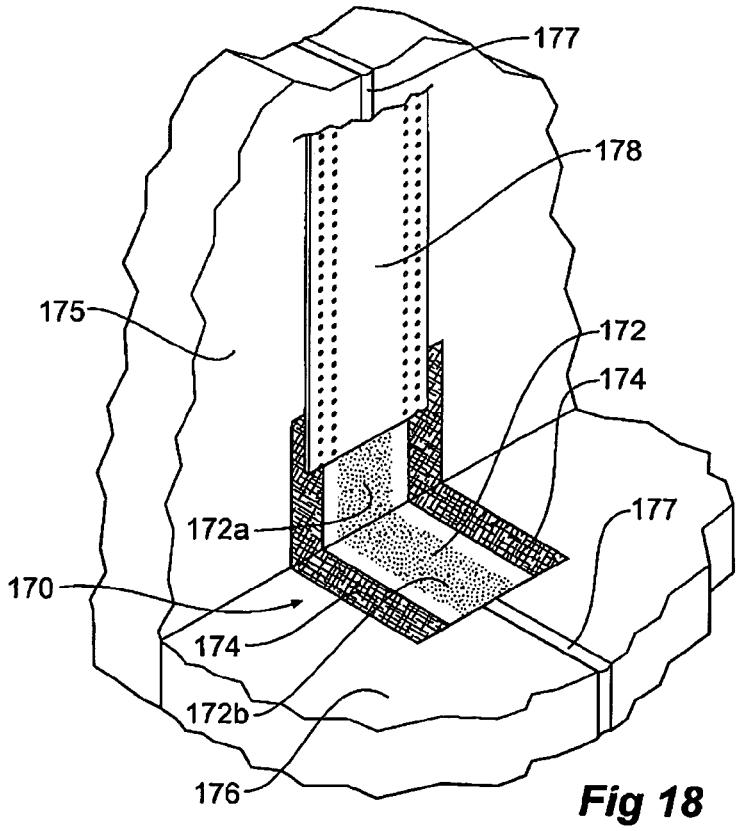
FIG. 18 shows an alternative embodiment of sealing member as an internal capping member according to the present invention.

FIG. 18 shows an alternative embodiment of sealing member as an internal capping member according to the present invention. The internal capping sealing member 170 comprises an elastomeric region 172 in two planar portions 172*a* and 172*b* at right angles to each other and fabric adhesive receiving regions 174 to each side of the elastomeric region 172. The external capping sealing member 170 fits on the inside edge of a pair of concrete slabs 175, 176, for instance across an expansion joint 177. A continuous further strip of expansion joint sealing member 178 can be extended along the balance of the expansion joint 177 in each direction from the capping member.

Figure 19:
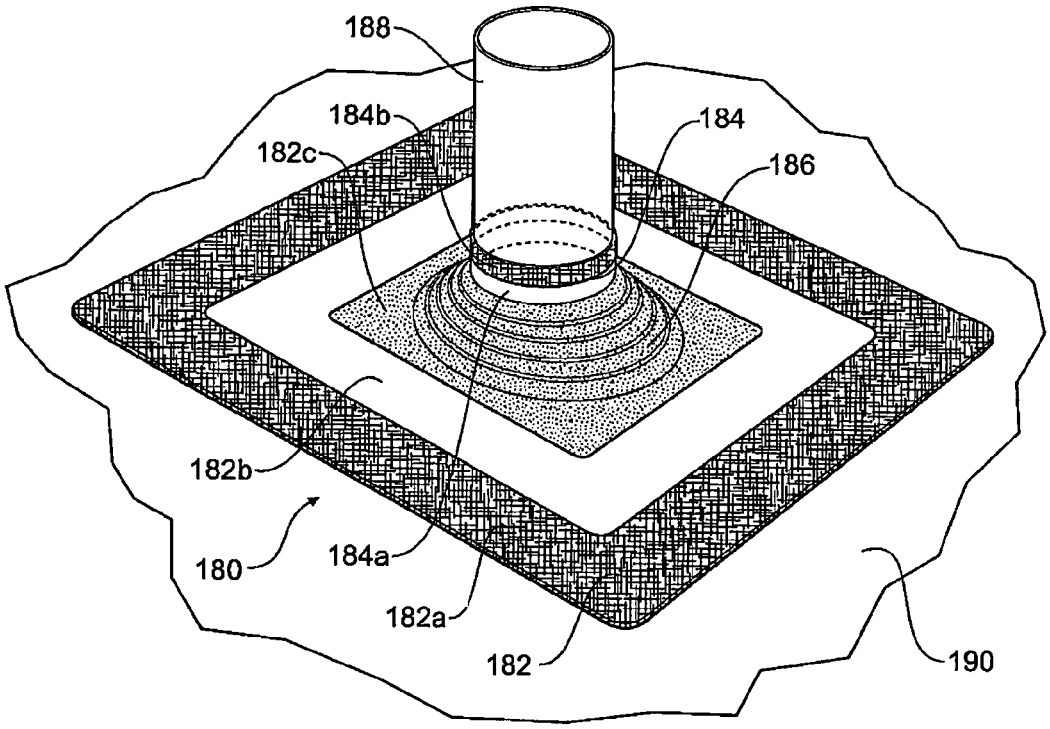
FIG. 19 shows a alternative embodiment of sealing member according to the present invention suitable for sealing around a pipe or duct through a roof structure for instance.

FIG. 19 shows a alternative embodiment of sealing member according to the present invention suitable for sealing around a pipe or duct through a roof structure for instance. The sealing member 180 comprises a planar portion 182, a cylindrical portion 184 and a concentric corrugated portion 186 between the planar portion 182 and the cylindrical portion 184. The concentric corrugated portion 186 allows a range of angles for a duct 188 passing through a roof structure 190 and relative movement between the duct 188 and the roof structure 190. The planar portion 182 is comprised of an adhesion region 182*a*, a transition region 182*b* and an elastomeric region 182*c*. The corrugated portion 186 is elastomeric and the cylindrical portion 184 is comprised of a transition portion 184*a* and an adhesive receiving portion 184*b*.

In FIG. 19 the length and width can be from 200 mm by 200 mm up to 1 m by 1 m. Internal elastomeric portion can be from 50 mm by 50 mm up to 600 mm by 600 mm. The concentric corrugated portion can be from 50 mm to 400 mm. The central aperture can be from 20 mm to 300 mm.

In all of the above embodiments the cloth or fabric portion around the periphery of the elastomeric portion may be formed from synthetic or non-synthetic fabrics, fibreglass, polyester, polypropylene, non-woven material or a fleecy or felt-like material.

Generally it will be seen that the sealing member for joints or compound expansion joints according to the present invention has a free zone of elastomeric material which in use overlies the expansion joint to allow relative movement across the expansion joint and a zone around the periphery of the free zone which enables the sealing member to be adhered to the surface around the expansion joints.

The sealing member according to the present invention may be used for instance on control joints, movement and expansion joints on building sites, pipes, penetrations and fixtures through wall and floor surfaces, wall/floor junctions and general substrate abutments, corner intersections between building surfaces, bathrooms, roofs and planter boxes.

It will be seen therefore by the various embodiments of this invention a sealing member can be made to cover compound joints such as T's, crosses, L-shapes, three dimensional shapes and pipes and ducts but the invention is not limited to the particular orientations of expansion joints discussed but is directed to joints such as compound expansion joints and other joints where there is expected to be relative movement in two or three dimensions.

The invention claimed is:

1. A unitary sealing member adapted to be applied to a compound structural joint defined by joint lines in at least two dimensions in a building construction, the unitary sealing member including a non-adhering elastomeric portion formed from a material selected from the group comprising nitrile butadiene rubber, ethylene propylene diamine rubber, styrene butadiene rubber, neoprene and urethane elastomers, said elastomeric portion in use to overlie the lines of the joint and adhesive receiving regions located to each side of and separated by the elastomeric portion, the adhesive receiving regions to be adhered to material adjacent to the compound structural joint, the elastomeric portion extending along each line of the joint in use to allow relative movement across the expansion joint and wherein the adhesive receiving regions include a fabric and the sealing member further comprises relatively inextensible transition regions located between the elastomeric portion and the adhesive portions wherein the fabric is moulded into or adhered to a periphery of the elastomeric portion, the fabric being exclusively included in the adhesive receiving regions and the transition regions and not across the elastomeric portion.

2. A sealing member as in claim 1 wherein the elastomeric portion is in a shape selected from the group comprising planar shapes including T-shaped, L-shaped, cross-shaped and star-shaped.

3. A sealing member has in claim 1 wherein the elastomeric portion is in a shape selected from the group comprising three dimensional shapes including intersection of curves and straight lines, inside corners, outside corners and intersection of cylindrical and planar shapes.

4. A sealing member as in claim 1 wherein the fabric is selected from the group comprising natural or synthetic material including cotton fabric or wool fabric or fibre glass cloth, polyester fabric or polypropylene cloth and in woven, non-woven or fleecy form.

5. A sealing member as in as in claim 1 wherein the adhesive receiving region comprises a plurality of apertures therein.

6. A sealing member as in claim 1 for use sealing a skylight, a pipe or a duct into a roof structure.

7. A sealing member as in claim 1 comprising at least two elongate elastomeric portions at an angle to each other and integrally joined to each other and the adhesive receiving portions to each side of each elastomeric portion.

8. A sealing member as in claim 7 wherein the fabric is selected from the group comprising natural or synthetic material including cotton fabric or wool fabric or fibre glass cloth, polyester fabric or polypropylene cloth and in woven, non-woven or fleecy form.

9. A sealing member as in claim 7 wherein the adhesive receiving region comprises a plurality of apertures therein.

10. A sealing member as in claim 7 wherein the elongate elastomeric portions together define a shape selected from the group comprising T-shaped, L-shaped, cross-shaped and star-shaped.

11. A sealing member as in as in claim 7 wherein the at least two elongate elastomeric portions are in separate planes and integrally joined at an intersection of the planes.

12. A unitary sealing member adapted to be applied to a compound structural joint defined by joint lines in at least two dimensions in a building construction, the unitary sealing member including a non-adhering, central elastomeric portion, a transition portion to each side of the non-adhering elastomeric portion and an adhesive receiving side portion to an outer side of each transition portion;

the non-adhering central elastomeric portion comprising an elastomeric material in use to overlie the lines of the joint and to absorb movement of the joint in use;

the adhesive receiving side portions to each side of the transition portions comprising solely an adhesive receiving fabric; and the transition portions comprising a relatively inextensible transition region located between the non-adhering, elastomeric portion and the adhesive receiving side portions, the transition portions comprising a portion of the adhesive receiving fabric of the adhesive receiving side moulded into or adhered to a periphery of the non-adhering, central elastomeric portion.

* * * * *